US006848302B1

(12) United States Patent
Williamson

(10) Patent No.: US 6,848,302 B1
(45) Date of Patent: Feb. 1, 2005

(54) AIR CURRENT DETECTION AID

(75) Inventor: Vance Williamson, Birmingham, AL (US)

(73) Assignee: Wind Checker Products, L.L.C., Birmingham, AL (US)

( * ) Notice: Subject to any disclaimer, the term of this patent is extended or adjusted under 35 U.S.C. 154(b) by 6 days.

(21) Appl. No.: 10/638,440

(22) Filed: Aug. 12, 2003

(51) Int. Cl.[7] ..... A63B 53/00
(52) U.S. Cl. ..... 73/170.04
(58) Field of Search ..... 73/170.04, 170.05, 73/170.01, 178 R, 861, 861.05; 116/200, 214, 264, 265, 273; 124/86–90; 42/1.01

(56) References Cited

U.S. PATENT DOCUMENTS 2,266,179 A * 12/1941 Hilmer et al. ..... 180/6.58
3,112,645 A 12/1963 Glass ..... 73/188
3,516,291 A * 6/1970 Gilbert et al. ..... 73/170.04
4,423,626 A 1/1984 Herschede ..... 73/188
4,509,751 A 4/1985 Tabet ..... 273/32 H
5,029,854 A 7/1991 Laskowitz et al. ..... 273/32 B
5,186,118 A 2/1993 Stinson ..... 116/214
6,550,418 B2 * 4/2003 Williamson ..... 116/264

* cited by examiner

*Primary Examiner*—William Oen
(74) *Attorney, Agent, or Firm*—Wm. Randell May

(57) ABSTRACT

A pouch-like receptacle for housing and dispensing a fibrous, windborne material useful in detecting air currents, air movement or wind speed and direction is disclosed. The receptacle includes at least one aperture or opening for accessing and dispensing said fibrous material and may include a reclosable opening for refilling the receptacle with said fibrous material as necessary or desirable. The receptacle is also adaptable so as to allow permanent incorporation or removable attachment of the device to a variety of items or articles, including golf accessories, bunting or observation accessories and articles of clothing.

15 Claims, 4 Drawing Sheets

AIR CURRENT DETECTION AID

BACKGROUND OF THE INVENTION

This invention relates generally to air movement detection devices and more specifically, to a new apparatus for housing and dispensing a natural or man-made windborne fibrous material useful in detecting the direction and speed of ambient air currents. The present invention is attachable to virtually any surface and/or may be incorporated into the construction of myriad products. The present invention is of particular use to golfers, athletes and other sportsmen such as hunters or archers, marksmen, professionals, military personnel, hobbyists, wildlife observers or in any other activity where knowledge of air movement, air currents, wind direction, wind speed and thermals may be important.

Knowledge of ambient air conditions, including wind direction, wind speed and thermal movement, is especially important where any type of athletic projectile, such as a golf ball, football, soccer ball, or high speed projectile, such as a bullet, slug or arrow, is being launched or propelled over relatively long distances to reach and accurately contact desired locations or specified targets.

Golfers, in particular, must be constantly aware of ambient air conditions during match play and practice. Prior to attempting a golf shot, most golfers will routinely pick up small pieces of grass, turf, debris or other lightweight material and will toss the material into the air in an attempt to detect and track air patterns, air movement, wind shifts, wind direction and/or wind speed. Knowledge of ambient air conditions allows the golfer to compensate for the air movement and to improve his or her chances for making a more accurate golf shot.

Firearm and bow hunters, soldiers, law enforcement personnel, competitive marksmen and/or athletes, all rely on knowledge of wind direction, wind speed and, in some cases, the thermal movement of air in order to ensure or improve the accuracy of their shots and, in some instances, to protect their lives. This is particularly true for long range outdoor shots where knowledge of wind direction and wind speed will allow one to accurately compensate for the effects of wind drift on the projectile (ball, bullet, arrow, etc.) being launched or shot thereby increasing the chances for success.

Hunters, without regard to the type of weapon used, and persons desiring to observe animals in the wild, must also closely monitor, and be constantly aware of, wind direction, wind shifts and thermals in order to avoid being detected or "winded" by the animal being observed or by the game or prey being hunted. Most game animals have a very keen sense of smell and a successful hunter or observer must frequently stop to check air currents or wind direction in order to stay downwind of the desired observation animal or intended prey. Experienced hunters and observers will therefore always strive to keep the wind in their face, regardless of how strong the breeze or air current may be, thereby significantly reducing the chances of the animal or prey picking up his or her human scent. Successful game hunters and observers will also remember to take daily thermals into account and have means available to check these currents at appropriate times during the day. For instance, in the evening when the atmosphere is cooling, the cooler air will tend to fall or sink thereby pushing air downhill. In the morning when the atmosphere is heating up, the warmer air will tend to rise thereby pulling air uphill. Monitoring these changes in daily thermals or air currents will allow a hunter or observer to avoid being "winded" by the observed animal or intended prey. Knowledge of ambient air conditions is particularly important when hunting or observing birds. Many larger birds, such as ducks or geese, will almost always attempt to land "into the wind" thereby requiring the hunter or observer to have accurate knowledge of wind direction in order to set up and conduct a successful hunt or observation session.

Football kickers, such as punters or place kickers, must also be constantly aware of ambient air conditions during games and practice. Prior to attempting a field goal, a punt or a kick off, a football kicker very often will pick up small pieces of grass or turf and will toss the material into the air in an attempt to detect and track air patterns, air movement, wind shifts, wind direction and/or wind speed. Knowledge of ambient air conditions allows the kicker to compensate for the air movement and to improve his or her chances for making a more accurate kick or shot. Similarly, soccer players, prior to attempting a penalty shot or corner kick, will generally use this technique to help them determine ambient wind direction and speed in order to improve the accuracy of their kicks or shots.

As discussed, present methods and devices for detecting and monitoring the direction and speed of air currents include tossing particles of grass, turf or other lightweight material into the air and observing the movement of the material. Other methods include observing the movement of pin flags, streamers or other objects easily disturbed by air currents, the use of lighters or matches to observe the direction or movement of the generated flame, puff bottles filled with observable powder or mist which can be squeezed or otherwise caused to spray said powder or mist into the air for observation, strings attached to the end of a rifle barrel and the use of dust or other free floating material which can be dropped from a hand-held container. However, while these prior art methods and devices are indeed useful in detecting air currents or wind direction, the inconvenience, unreliability, noise, chemical odor, potential visual detection, physical handling and movement associated with the use of these methods and devices leave much room for improvement. Additionally, some of these methods and devices are weather sensitive and may not work properly or be effective in all weather conditions.

It would be expedient, therefore, to provide an improved method and apparatus for quickly, easily, accurately and very conveniently aiding one in detecting ambient air currents, wind direction, wind shifts, wind speed and thermals at all times, in any weather, without excessive body movement or motion, without odor, and/or without the necessity of propelling or spraying visually detectable and/or odorous substances into the air.

SUMMARY OF THE INVENTION

In view of the foregoing, it is a primary object of this invention to provide an air current detection aid comprising an apparatus for storing and dispensing a windborne fibrous material useful in monitoring ambient air movement. It is a further primary object of the present invention to provide an air current detection aid which is attachable to virtually any surface and which is very convenient to use. The design of the present invention allows the apparatus to be permanently or removeably attached to, or incorporated within, a variety of items including, but in no way limited to, golf accessories (golf gloves, club bags, towels, hats, etc.), hunting or observation accessories (optical aids, backpacks, ear muffs, hand warmers, gun cases, bow cases, tree stands, etc.), and to articles of clothing (gloves, hats, jackets, pants, shirts, belts, shoes, boots, etc.).

According to an embodiment of the invention, an air current detection aid comprises a pouch-like receptacle or pocket for receiving and holding a fibrous wind-borne material. Said wind-borne material comprising natural or man-made fibers that are easily separated and, once separated, tend to float upon, and be carried along by, ambient air currents or air movement. Said pouch-like receptacle includes at least one aperture or opening for accessing and dispensing said fibrous material. The receptacle may also include a reclosable opening for refilling the receptacle with said fibrous material. Further, the receptacle may be designed to be disposable as where the article to which the receptacle may be permanently attached (golf glove, etc.) routinely wears out or is damaged and must be replaced. One side of said receptacle may be adapted so as to allow the device to be removeably attached to other objects or materials.

An advantage of the present invention is the provision of an air current detection aid which can be incorporated, permanently or removeably, into a variety of items either worn or carried by the user.

Another advantage of the present invention is the provision of an air current detection aid that is adaptable so as to be easily incorporated, permanently or removeably, into the design of various articles, including golf or hunting accessories, without altering the basic design of said articles.

Another advantage of the present invention is the provision of an air current detection aid which is very convenient to use and which provides the ability to accurately and easily check and monitor wind direction at all times in any type of weather.

A further advantage of the present invention is the provision of an air current detection aid which is refillable for repeated use or which may be disposable for one-time use or which may be attached to a disposable article.

Another advantage of the present invention is the provision of an air current detection aid which can be adapted to attach to structural and/or moveable objects such as golf carts, golf club bags, binoculars, telescopes, hunting or observation platforms, or tree stands.

The invention is also particularly advantageous in that the attachment of the device to objects not likely to be left behind by a golfer, hunter, marksman or observer or the attachment of the device to stationary or portable structures used by the golfer, hunter, marksman or observer ensures the device will always be available for use.

An important advantage of the present invention is the provision of a refillable air current detection apparatus or aid that allows the user to detect air movement, wind direction and wind speed without the necessity of spraying visually detectable or odorous materials into the air.

Another advantage of the present invention lies in the convenience of the device and the ability to use the device without excessive body motion, movement or handling by the user.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
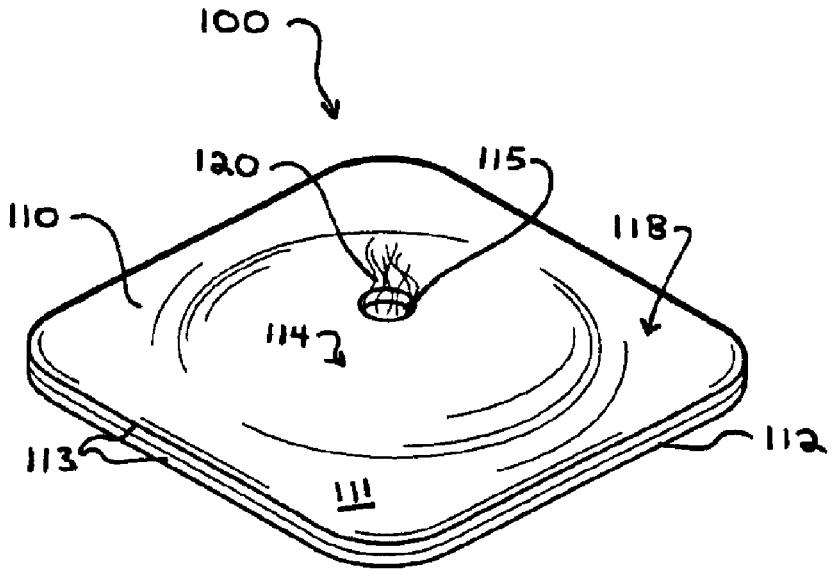
FIG. 1 is a perspective view of an embodiment of the present invention shown in an unattached or unincorporated configuration.
Figure 2:
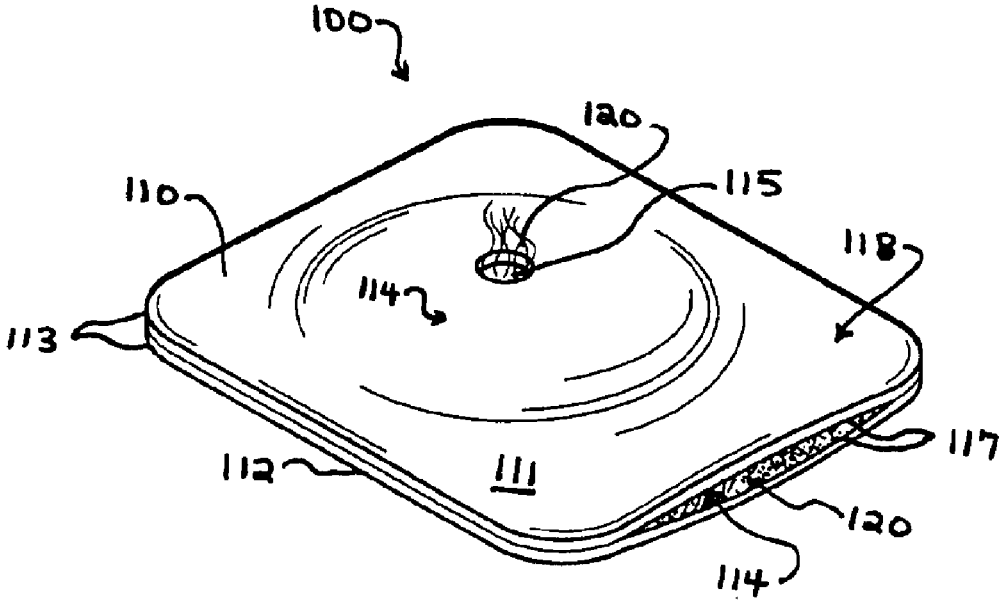
FIG. 2 is a perspective view of a refillable embodiment of the present invention showing the invention in an unattached or unincorporated configuration.
Figure 3:
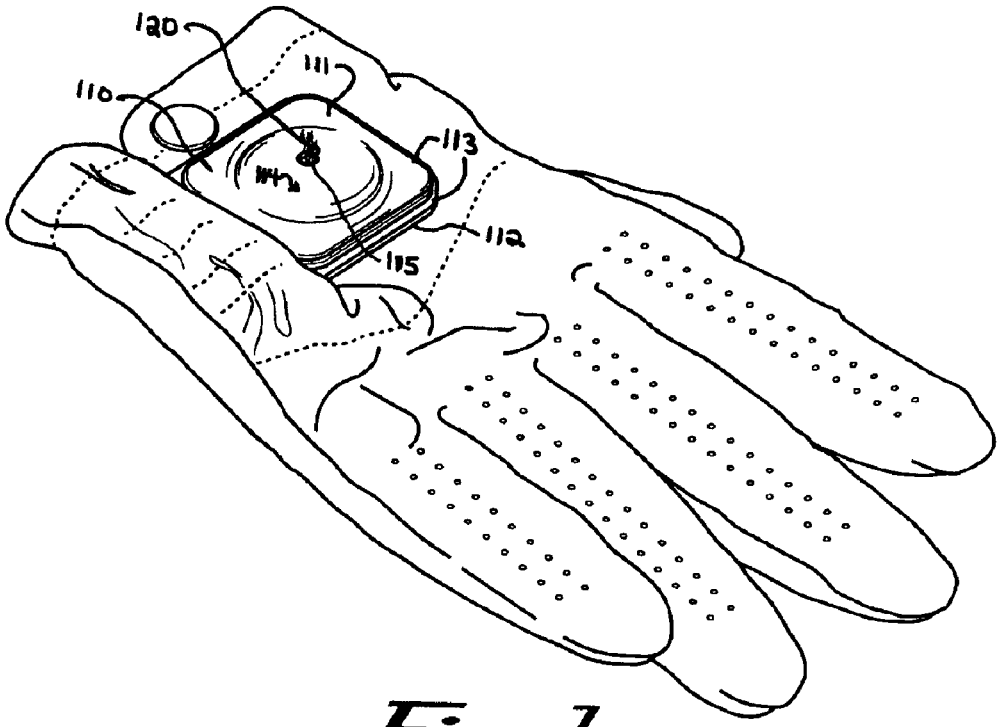
FIG. 3 is a perspective view of an embodiment of the present invention shown permanently incorporated into the wrist closure strap of a typical golf glove.

In accordance with an embodiment of the invention, FIGS. 1 and 2 show an air current detection aid 100 in an unattached or unincorporated configuration. FIGS. 3 through 8 show the present invention 100 attached to, or incorporated into, various items, accessories or articles of clothing.

The air current detection aid 100 of FIG. 1 comprises a pouch-like receptacle means 110 for receiving, housing and dispensing a fibrous, wind-borne material 120. The receptacle means 110 of the preferred embodiment of FIG. 1 is shown as being generally square in shape (although the shape of said receptacle means 110 is not critical to the function of the invention 100 and can be of varied shapes with equal effectiveness) and is constructed of a flexible material such as leather, fabric or plastic. Said receptacle means 110 comprises an upper member 111 and a lower member 112 with each member 111, 112 having an inner surface 117 and an outer surface 118. Each member 111, 112 of said receptacle means 110 having outer edges 113 which, when substantially joined together, defines and forms a compartment or pocket 114 between said inner surfaces 117 of said receptacle means 110 for receiving and housing said fibrous, wind-borne material 120. The upper member 111 of said receptacle means 110 also comprises an aperture or opening 115, centrally positioned on said upper member 111, for access to the fibrous, wind-borne material 120 housed within the compartment or pocket 114 of said receptacle means 110. The lower member 112 of said receptacle means 110 has a generally smooth outer surface 118 and may be adapted so as to allow the receptacle means 110 to be removeably or permanently attached to the surface of another object or material.

Permanent attachment of the invention 100 to other surfaces may include sewing or gluing the outer surface 118 of said lower member 112 or outer edges 113 of said members 111, 112 of the device 100 to the surface of another article or object or may include the incorporation of the device 100 into the original manufacture or construction of the target article or object. Removable attachment of the invention 100 with another surface or object can be accomplished by various means including, but not limited to, the use of hook and loop material attached to the outer surface 118 of the lower member 112 of the invention 100 and to the target article or object or by the use of buttons, snaps, clips (not shown) or other means designed to allow the non-permanent attachment of the invention 100 to another object, article or surface.

Figure 4:
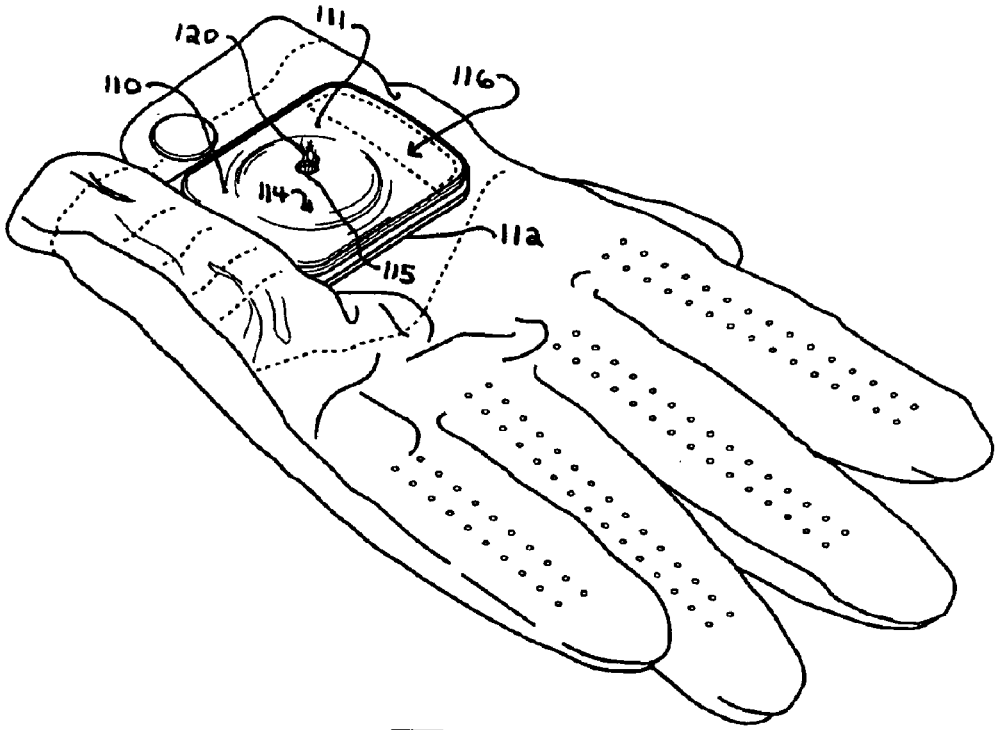
FIG. 4 is a perspective view of a refillable embodiment of the present invention shown permanently incorporated into the wrist closure strap of a typical golf glove.
Figure 5:
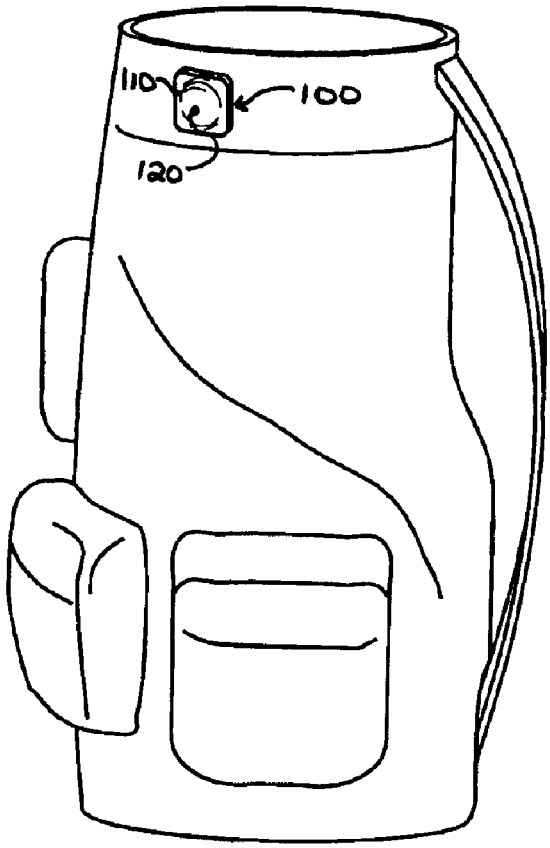
FIG. 5 is a perspective view of an embodiment of the present invention shown attached to a typical golf club bag.
Figure 6:
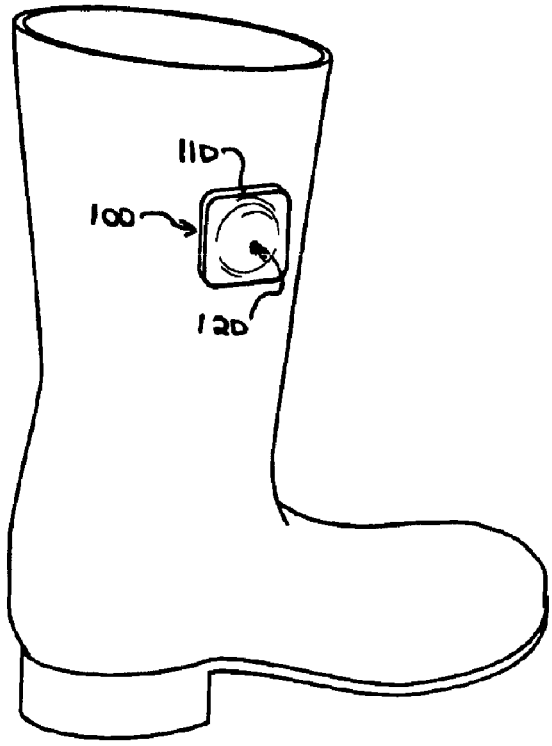
FIG. 6 is a perspective view of an embodiment of the present invention shown attached to a typical boot.
Figure 7:
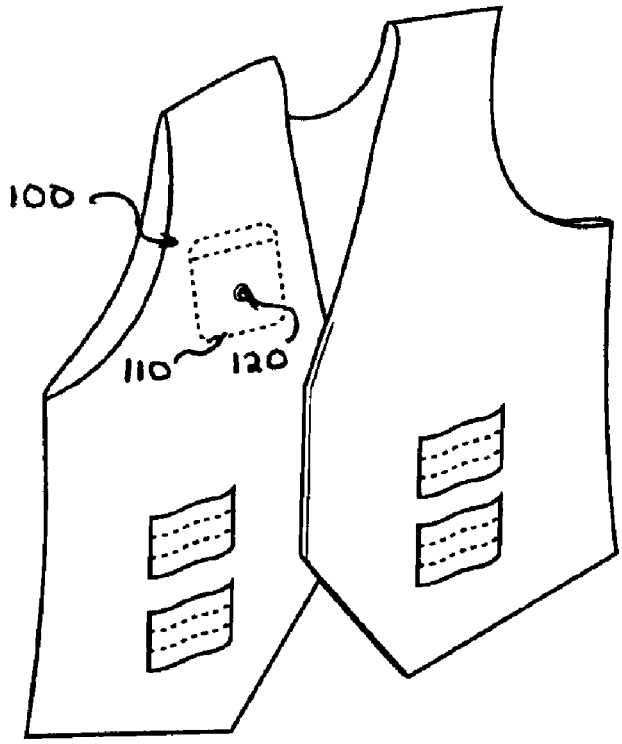
FIG. 7 is a perspective view of an embodiment of the present invention shown incorporated into an article of clothing.
Figure 8:
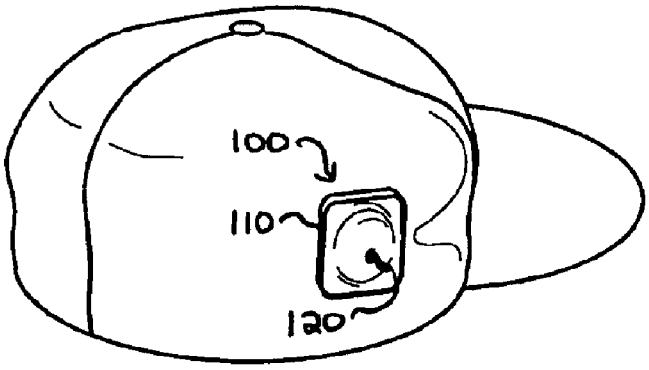
FIG. 8 is a perspective view of an embodiment of the present invention shown attached to a typical hat.

As best shown in FIG. 4, the air current detection aid 100 of the present embodiment may also be adapted so as to allow the device 100 to be refillable with said fibrous, wind-borne material by providing a refill opening 116 along one edge 113 of the upper and lower members 111 and 112, or along a portion of one edge 113 of said upper and lower members 111 and 112, of the receptacle means 110. Said refill opening 116 may also be provided with a means to temporarily close the opening 116 such as by the incorporation of hook and loop material along the edges 113 of said opening 116 between the inner surfaces 117 of the upper and lower members 111 and 112 thereof or by the incorporation of other non-permanent fastener means such as buttons or snaps (not shown).

As shown in FIGS. 3–8, and as previously stated, the air current detection aid 100 of the present invention may be permanently or removeably attached to, or incorporated within, a variety of objects, articles or surfaces including, but not limited to, golf accessories, hunting or observation accessories and articles of clothing.

The fibrous, wind-borne material 120 contemplated for use with the present invention may be comprised of any lightweight fibrous material, natural or man-made, having a density or consistency such as would allow the fibers of the material 120 to be easily separated and, upon separation and release, would cause the fibers to have a tendency to float upon, and be carried along by, ambient air currents or air movement. The material 120 may also vary in color and density for easier detection in snowy conditions or where other weather related or environmental conditions may require higher visibility.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. An air current detection aid comprising:

a fibrous wind-borne material having fibers which are easily separated and once separated tend to float upon, and be carried along by, air currents;

a pouch-like receptacle for receiving, housing and dispensing said fibrous wind-borne material and for attachment to other objects or surfaces comprising:

a pair of flexible members comprising an upper member and a lower member with said members being substantially attached one to the other along the edges of said members in order to form or define a chamber or pocket between said members for receiving and housing said fibrous material;

an aperture or port, positioned on said upper member, through which a portion of said fibrous material housed within said chamber or pocket may be accessed and dispensed; and, a means for attaching said pouch-like receptacle to another object or surface.

2. The apparatus of claim 1, wherein said air current detection aid is permanently attached to, or incorporated within, another object or surface.

3. The apparatus of claim 1, wherein said air current detection aid is removeably attached to another object or surface.

4. The apparatus of claim 1, wherein said means for attaching said pouch-like receptacle to another object or surface comprises sewing said receptacle onto said object or surface.

5. The apparatus of claim 1, wherein said means for attaching said pouch-like receptacle to another object or surface comprises gluing said receptacle to said object or surface.

6. The apparatus of claim 1, wherein said means for attaching said pouch-like receptacle to another object or surface comprises the use of hook and loop material.

7. The apparatus of claim 1, wherein said air current detection aid is attached to golfing, hunting, sporting or observation accessory items such as a gloves, bags, cases, optical aids, backpacks or similar articles.

8. The apparatus of claim 1, wherein said air current detection aid is attached to an article of clothing or clothing accessory.

9. The apparatus of claim 1, wherein said air current detection aid is attached to or incorporated within the external surface of a typical golf or hunting glove.

10. The apparatus of claim 1, wherein the flexible members of said pouch-like receptacle are attached to each other so as to leave an opening along a portion of the edges of said members for filling and refilling said receptacle with said fibrous wind-borne material as necessary or desirable.

11. The apparatus of claim 10, wherein said refill opening along a portion of the edges of said members is provided with a means for non-permanent closure of said opening.

12. The apparatus of claim 11, wherein said means for non-permanent closure of said refill opening comprises the use of hook and loop material.

13. The apparatus of claim 1, wherein said fibrous, wind-borne material is comprised of natural fibers.

14. The apparatus of claim 1, wherein said fibrous, wind-borne material is comprised of man-made or artificial fibers.

15. The apparatus of claim 1, wherein said fibrous, wind-borne material is comprised of colored fibers.

* * * * *